US005457354A

United States Patent [19]

Tu Tay

[11] Patent Number: 5,457,354

[45] Date of Patent: Oct. 10, 1995

[54] LAMP WITH IMPROVED MOUNT FOR LIGHT-SOURCE CAPSULE

[75] Inventor: Thang Tu Tay, Bedford, N.H.

[73] Assignee: Osram Sylvania Inc., Del.

[21] Appl. No.: 312,344

[22] Filed: Sep. 26, 1994

[51] Int. Cl.[6] ..... H01J 61/34

[52] U.S. Cl. ..... 313/25; 313/634

[58] Field of Search ..... 313/25, 113, 634

[56] References Cited

U.S. PATENT DOCUMENTS

| | | | |
|---|---|---|---|
| 2,863,094 | 12/1958 | Morin et al. | 313/25 |
| 5,043,623 | 8/1991 | Scholtz | 313/25 |
| 5,065,069 | 11/1991 | Hunter | 313/25 |
| 5,225,733 | 7/1993 | Krasko | 313/25 |
| 5,252,885 | 10/1993 | Muzeroll et al. | 313/25 |

*Primary Examiner*—Donald J. Yusko

*Assistant Examiner*—Nimesh D. Patel

*Attorney, Agent, or Firm*—William H. McNeill

[57] ABSTRACT

An electric lamp assembly comprises a sealed light-transmissive lamp envelope enclosing an interior; a lamp capsule having at least one end located within the interior for generating light upon application of electrical energy, said capsule having a central axis and a press seal formed in said end; two lead-in wires sealed in said envelope; a light-transmissive shroud surrounding said capsule; and a frame within the interior for supporting said capsule and shroud, the frame being mechanically mounted within the interior at one end thereof by an isolation bridge connected between the frame and one of the lead-in wires. The isolation bridge comprises an electrically insulating member of a suitable ceramic having electrically conductive end caps thereon. The end caps contain leads one of which is welded to a stem lead and the other of which is welded to a lower portion of the frame. The assembly eases automation of the lamp.

4 Claims, 1 Drawing Sheet

LAMP WITH IMPROVED MOUNT FOR LIGHT-SOURCE CAPSULE

TECHNICAL FIELD

This invention relates to electric lamps and more particularly to such lamps having a light source capsule surrounded by a light-transmissive shroud. Still more particularly, it relates to a mount for supporting an assembly of a capsule and a shroud within a lamp envelope.

BACKGROUND ART

Many modern-day lamps, such as high intensity arc discharge lamps, employ a light source capsule surrounded by a light transmissive shield to provide desirable thermal characteristics and to aid in containment in the unlikely event of a capsule burst.

Such lamps are shown, for example, in U.S. Pat. No. 5,252,885, and include a capsule-shroud assembly mounted on a frame which has one end mounted to the glass of the press-sealed end of the lamp envelope and the other end of the frame engaging a dimple formed at the opposite end of the lamp envelope.

This structure is costly and difficult to automate and, further, is easily distorted during assembly. Many types of lamps employing this construction have an internal coating on the lamp envelope which can be scratched when the assembly is inserted, resulting in a rejected lamp.

DISCLOSURE OF THE INVENTION

It is, therefore, an object of this invention to obviate the disadvantages of the prior art.

It is another object of the invention to enhance the assembly operations of lamp construction.

Still another object is the provision of a rugged capsule-shroud assembly.

These objects are accomplished, in one aspect of the invention, by an electric lamp assembly which comprises a sealed light-transmissive lamp envelope enclosing an interior and a lamp capsule having at least one end located within the interior for generating light upon application of electrical energy. The capsule has a central axis. A press seal is formed in the end of the lamp envelope and two lead-in wires are sealed therein. A light-transmissive shroud surrounds the capsule and a frame within the interior supports the capsule and shroud. The frame is mechanically mounted within the interior at one end thereof by an isolation bridge connected between the frame and one of the lead-in wires.

This structure eliminates the problems associated with the frame being attached to the press seal and provides a rugged assembly.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
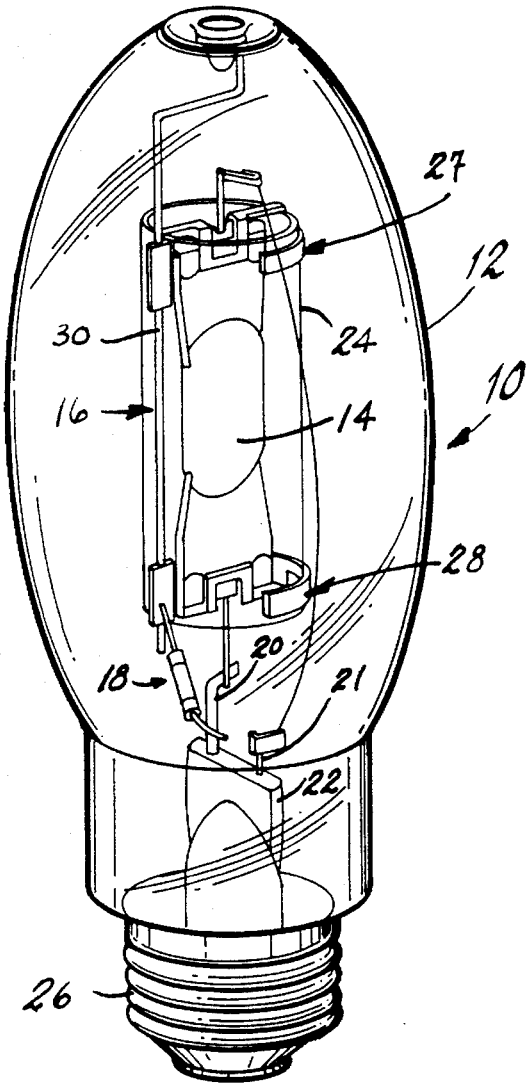
FIG. 1 is a perspective view of a lamp using an embodiment of the invention.
Figure 2:
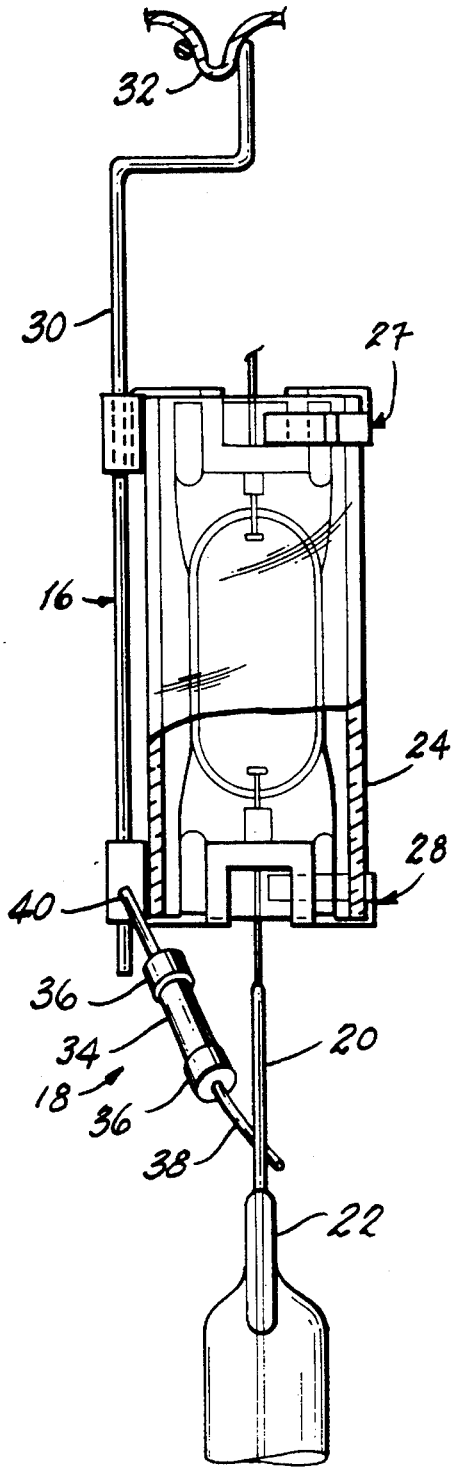
FIG. 2 is a partial, elevational view of a lamp mount using the invention.
Figure 3:
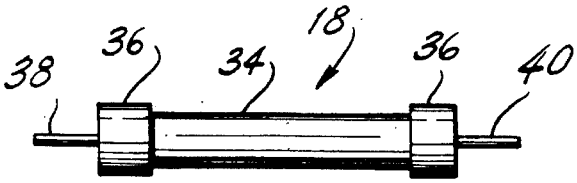
FIG. 3 is a plan view of an isolation bridge used with the invention.

Referring now to the drawings with greater particularity there is shown in FIG. 1 a lamp 10 having an outer envelope 12 containing an arc tube or lamp capsule 14 carried within the outer envelope 12 by a frame 16. The frame 16 is mounted within the envelope interior by an isolation bridge 18 connected between the frame 16 and one of the lead-in wires (or stem leads) 20 or 21 which extends from the envelope press seal 22.

The capsule 14 is substantially centrally located within a shroud 24 which is also mounted to frame 16, as will be explained hereinafter. Electrical energy is coupled to the capsule 14 through a lamp base 26 which includes the press seal 22 and the electrical lead-in wires 20 and 21. The capsule 14 can be a metal halide arc discharge tube, a tungsten halogen incandescent capsule or any other light source which is advantageously operated with a shroud. The shroud itself is preferably formed from quartz; an aluminosilicate glass; or other suitable light transmissive, heat resistant material.

Frame 16 includes upper mounting clip 27 and a lower mounting clip 28 which secure the capsule and shroud to support rod 30, all as shown in the above-identified U.S. Pat. No. 5,252,885, the appropriate teachings of which are hereby incorporated by reference. The upper end of rod 30 is formed to attach to a dimple 32 formed in the envelope 12.

The frame-capsule-shroud assembly is mounted within the envelope 12, at the lower end thereof, solely by the isolation bridge 18. The isolation bridge 18 comprises a rigid, electrically insulating body 34 formed, for example, from a suitable ceramic material such as steatite having electrically conductive members 36 at each end. The conductive members are cup-shaped and preferably are formed from No. 42 alloy (42% nickel, balance iron) and have extending leads 38, 40,, attached thereto, as by welding. The leads can be copper coated iron or pure nickel and preferably are 0.030" (0.76 mm) in diameter. The ceramic body is preferably 3 mm in diameter and has a length of about 13 min. To insure rigidity in the mounted structure, the lead-in wires are preferably about 0.060"–0.070" (1.5 mm–1.8 mm) in diameter.

The mount assembly is fixed in place by welding one of the extending leads, for example, 38, to a lead-in wire 20 and the other lead 40 to the lower portion of frame 16.

This construction eliminates the necessity of the prior art neck mount and greatly eases the automated assembly of the lamp.

While there have been shown an described what are at present considered the preferred embodiments of the invention, it will be apparent to those skilled in the art that various changes and modifications can be made herein without departing from the scope of the invention as defined by the appended claims.

What is claimed is:

1. An electric lamp assembly comprising: a sealed light-transmissive lamp envelope enclosing an interior; a lamp capsule having at least one end located within said interior for generating light upon application of electrical energy, said capsule having a central axis and a press seal formed in said end; two lead-in wires sealed in said envelope; a light-transmissive shroud surrounding said capsule; and a frame within said interior for supporting said capsule and shroud, said frame being mechanically mounted within said interior at one end thereof by an isolation bridge connected between said frame and one of said lead-in wires.

2. The lamp assembly of claim 1 wherein said isolation bridge comprises a rigid, electrically insulating body having electrically conductive members at each end thereof, one of said members being connected to said frame and the other of said members being connected to said lead-in wire.

3. The lamp assembly of claim 2 wherein said electrically conductive members comprise cup-shaped elements surrounding the ends of said insulating body.

4. The lamp assembly of claim 3 wherein said frame includes a support rod mounted at a second end to a dimple formed in said lamp envelope.

* * * * *